US008627628B2

(12) United States Patent
McClure

(10) Patent No.: US 8,627,628 B2
(45) Date of Patent: Jan. 14, 2014

(54) OVER-PURLIN INSULATION SYSTEM FOR A ROOF

(75) Inventor: Richard R. McClure, Basehor, KS (US)

(73) Assignee: BlueScope Buildings North America, Inc., Kansas City, MO (US)

( * ) Notice: Subject to any disclaimer, the term of this patent is extended or adjusted under 35 U.S.C. 154(b) by 11 days.

(21) Appl. No.: 13/296,938

(22) Filed: Nov. 15, 2011

(65) Prior Publication Data

US 2012/0124930 A1 May 24, 2012

Related U.S. Application Data

(60) Provisional application No. 61/413,647, filed on Nov. 15, 2010.

(51) Int. Cl.
*E04B 1/74* (2006.01)

(52) U.S. Cl.
USPC ..... 52/404.3; 52/404.1; 52/407.3; 52/408; 52/483.1

(58) Field of Classification Search
USPC ..... 52/404.1, 404.3, 407.3, 408, 410, 478, 52/483.1, 749.12
See application file for complete search history.

(56) References Cited

U.S. PATENT DOCUMENTS 3,513,614 A * 5/1970 Studzinski ..... 52/742.12
3,662,509 A * 5/1972 Studzinski ..... 52/404.1
3,914,916 A 10/1975 Simpson et al.
4,047,346 A * 9/1977 Alderman ..... 52/407.4
4,058,949 A * 11/1977 Bellem ..... 52/407.1
4,075,806 A 2/1978 Alderman
4,081,938 A 4/1978 Bertacchi et al.
4,329,823 A * 5/1982 Simpson ..... 52/407.4
4,346,543 A * 8/1982 Wilson et al. ..... 52/404.2
4,361,993 A 12/1982 Simpson
4,379,381 A * 4/1983 Holcombe ..... 52/404.3
4,446,665 A 5/1984 Berger
4,528,789 A 7/1985 Simpson
4,557,092 A 12/1985 Brueske
4,566,239 A * 1/1986 Smigel et al. ..... 52/407.4
4,571,909 A 2/1986 Berghuis
4,642,961 A 2/1987 Cruise
4,651,493 A 3/1987 Carey
4,715,156 A * 12/1987 Dozzo ..... 52/404.3
4,873,808 A 10/1989 Heisey, Jr. et al.
5,406,764 A 4/1995 Van Auken et al.
5,551,203 A * 9/1996 Alderman et al. ..... 52/746.11
5,724,780 A * 3/1998 Bolich ..... 52/407.4
6,421,980 B1 * 7/2002 Alderman et al. ..... 52/746.11
6,694,693 B2 * 2/2004 Alderman ..... 52/478
2003/0167718 A1 * 9/2003 Alderman ..... 52/407.3

* cited by examiner

*Primary Examiner* — James Buckle, Jr.
(74) *Attorney, Agent, or Firm* — Lathrop & Gage LLP

(57) ABSTRACT

A system and method for insulating a metal roof includes a thermal block arrangement disposed over each of a pair of purlins. A vapor-barrier sheet spans between and is secured over the opposing pair of purlins, the vapor-barrier sheet being secured underneath each thermal block arrangement. A batt insulation receiving cavity is defined by an upper surface of the vapor-barrier sheet and between opposing faces of each of the thermal block arrangements.

11 Claims, 2 Drawing Sheets

OVER-PURLIN INSULATION SYSTEM FOR A ROOF

CROSS-REFERENCE TO RELATED APPLICATIONS

This application claims the benefit of U.S. Provisional Application No. 61/413,647 filed Nov. 15, 2010, the disclosure of which is incorporated herein by reference.

BACKGROUND OF THE INVENTION

1. Field of the Invention

The invention relates generally to the field of roof structures and related methods. More specifically, the invention relates to the field of insulating metal roofing structures.

2. Description of the Related Art

Roof insulation has been used in metal building arrangements. A typical roof insulation configuration uses blanket insulation. The thermal resistance offered by the insulation is compromised when it is compressed or packed down. In conventional metal roof insulation systems, when the roof structure is applied to the tops of the roof purlins, the thick layer of blanket insulation is compressed, thus reducing the thermal resistance of the roof insulation system. In some areas of the conventional roof system, the compression of the insulation is so severe that a thermal short is created, thus substantially degrading the insulation properties of the roof insulation system.

SUMMARY

According to one aspect, the present disclosure provides a system comprising a thermal block arrangement over each of a pair of purlins. A vapor-barrier sheet spans between and is secured over the opposing pair of purlins, the vapor-barrier sheet being secured underneath each thermal block arrangement. A batt insulation receiving cavity is defined by an upper surface of the vapor-barrier sheet and between opposing faces of each of the thermal block arrangements.

According to another aspect, the present disclosure provides a system comprising a thermal block arrangement over each of an opposing pair of purlins. A vapor-barrier member spans between and is secured over the opposing pair of purlins, the vapor-barrier member extending between each thermal block arrangement. An insulation receiving cavity is defined by an upper surface of the vapor-barrier member and between opposing faces of each of the thermal block arrangements, the cavity being substantially rectangular in cross section.

According to another aspect, the present disclosure provides a method of providing insulation in a metal roof, the method comprising: draping a vapor-barrier sheet over a plurality of purlins; forming a bottom of each of a plurality of thermal blocks such that when the thermal blocks are placed over each purlin the vapor-barrier sheet is pushed down over a top of the purlin, thus creating an insulation receiving area between the purlins; placing the thermal blocks longitudinally above each of the purlins; fastening a plurality of clips above and along the length of the thermal block; spacing additional blocks between each clip fastened such that opposing lateral walls of the additional blocks define an upper part of the insulation receiving area; laying insulation into the insulation receiving area; and seaming the clips into a metal roof structure placed above the additional blocks and insulation.

According to another aspect, the present disclosure provides a system for insulating a metal roof, the metal roof having a plurality of purlins, the system comprising a vapor-barrier sheet above the purlins; a plurality of thermal blocks located longitudinally above each purlin, the thermal blocks being configured such that they fit over the purlins and push the vapor-barrier sheet down such that insulation receiving areas are formed between the purlins; bearing members over the thermal blocks onto which a plurality of clips are fastened with fasteners, the fasteners being installed such that they bite into the top of the purlins and compress the thermal blocks down, sandwiching the vapor-barrier sheet therebetween; a plurality of spacer blocks installed between the clips and further contributing to create the insulation receiving area; and a piece of batt insulation laid in each of the insulation receiving areas. The clips are seamed into a metal roof structure installed above the pieces of insulation and the spacer blocks.

BRIEF DESCRIPTION OF THE DRAWINGS

The foregoing and other features and advantages will be apparent from the more particular description of preferred embodiments, as illustrated in the accompanying drawings, in which like reference characters refer to the same parts throughout the different views. The drawings are not necessarily to scale; the sizes of elements may be exaggerated for clarity.

DETAILED DESCRIPTION

The present disclosure provides systems and methods for providing insulation for a metal roof, according to various embodiments.

Figure 1:
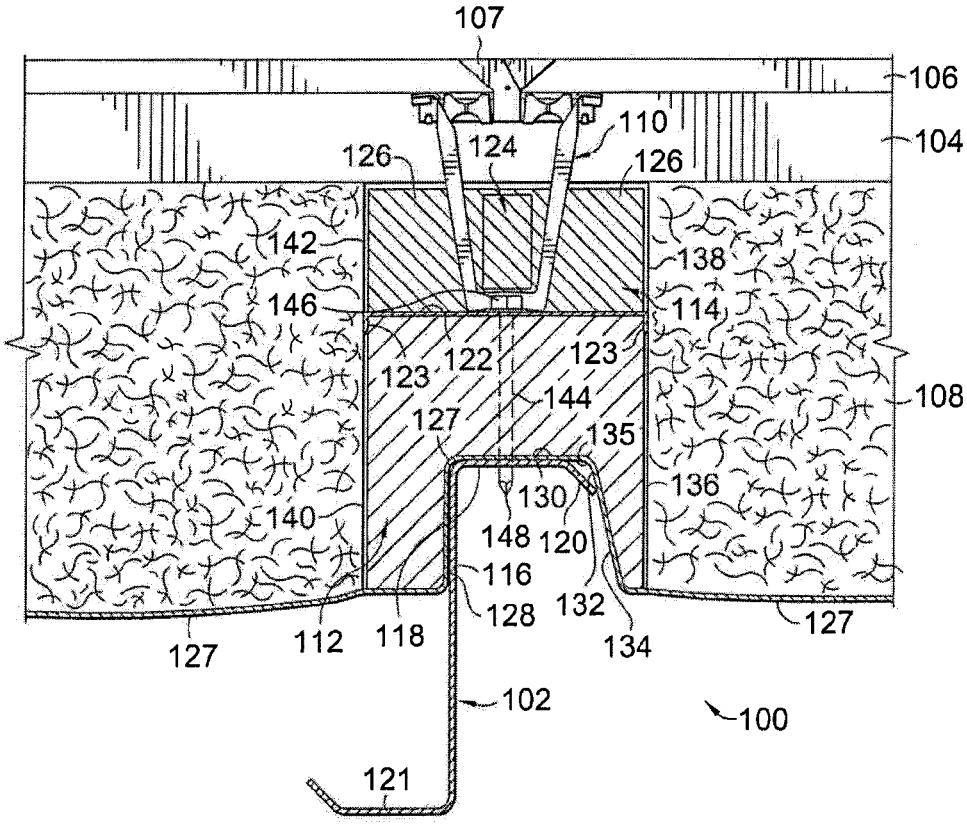
FIG. 1 is a schematic cross-sectional view taken at a purlin showing insulation structures, according to an embodiment.
Figure 2:
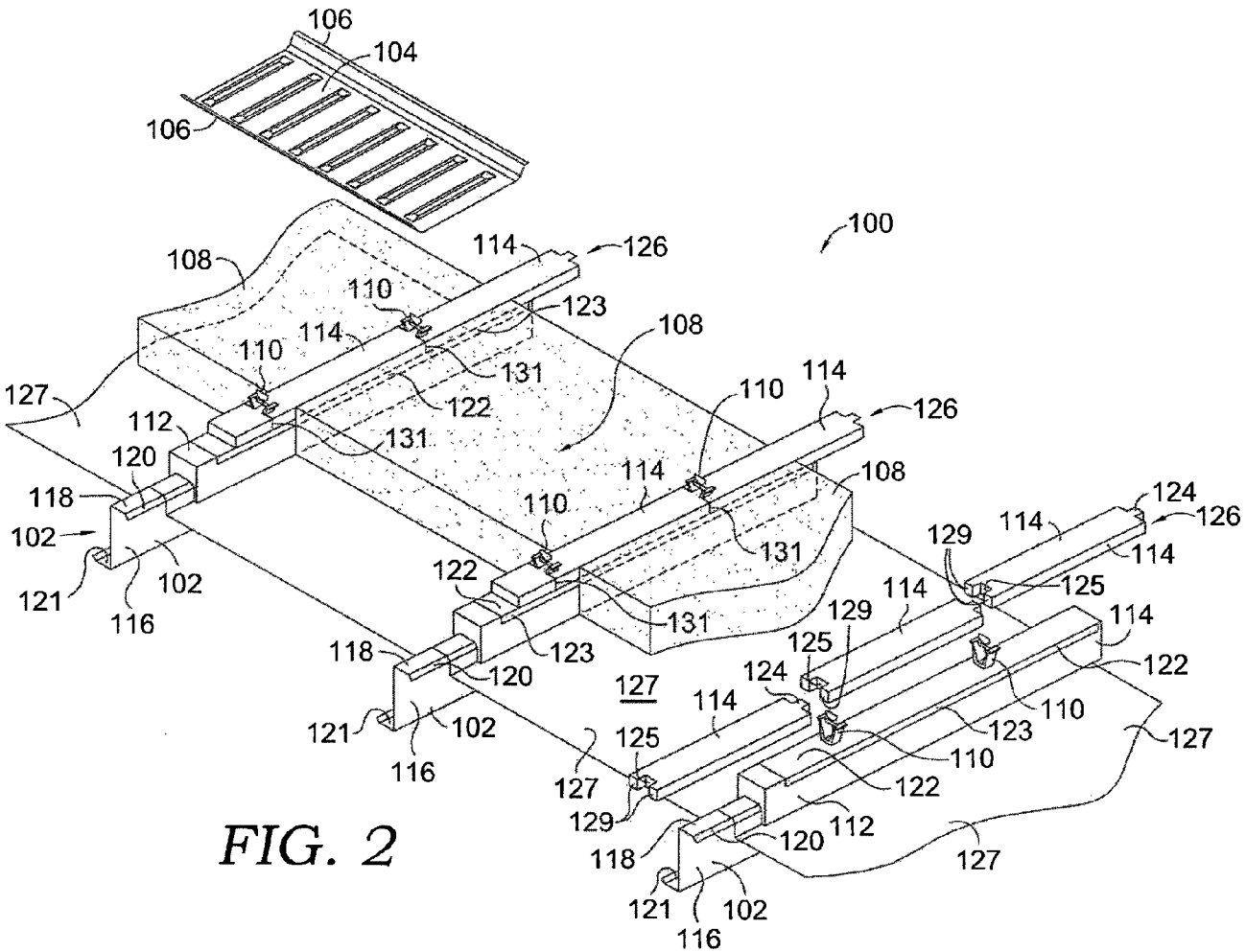
FIG. 2 is a schematic perspective view of an over-purlin system, according to an embodiment.

According to one aspect, a system 100 according to the disclosure includes a thermal block arrangement which is mountable on a plurality of parallel purlins as part of a roofing system. The arrangement is depicted in FIGS. 1-2. FIG. 1 illustrates a cross-sectional view of the system 100 taken from a plane perpendicular to a longitudinal purlin. Although the system can be used with different kinds of purlins (e.g., C-shaped and other varieties), the purlin 102 shown in FIGS. 1-2 is Z-shaped and is, therefore, referred to as a Z-purlin. Z-purlins typically have a vertical web portion 116 and a horizontal top 118. The horizontal top 118 has a downwardly sloped front lip 120. The bottom portion 121 of purlin 102 has a similarly-shaped configuration that extends in an opposite direction from the direction of the top portion 118.

System 100 enables the mounting of batt insulation above and about a Z-purlin 102. As is normally the case, a plurality of purlins (like purlin 102) is regularly spaced in parallel underneath roof panels. In this embodiment, purlin 102 is used to support a roof structure 104. Different panels of this roof structure are joined together at seams using, for example, a seamable raised edge 106, which is folded over to include flanges 107, which extend upward and are part of a clip 110. The flanges, when folded over inside the seamable edges 106, become part of the seam.

Those skilled in the art recognize that batt insulation comes in precut longitudinal panels (often marketed in rolls) and is commonly used to insulate floors, walls and ceilings. This sort of insulation is normally made of fiberglass, but is known to be constructed of other materials. With system 100, a plurality of panels of batt insulation 108 are able to be received in longitudinal cavities. These cavities are defined from below by a vapor-barrier sheet 127. The vapor-barrier sheet 127 is draped tightly over the plurality of purlins 102 as a preliminary step.

Then, a thermal block 112 and a spacer block 114 are installed on top of the vapor-barrier sheet 127 over the purlin 102 as can be seen in FIG. 2. Referring to that figure, it can be seen that blocks 112 and 114 run longitudinally along the upper portion of the Z-purlin 102. The spacer blocks 114 in the embodiment of FIGS. 1 and 2 terminate at each of the clips 110. It should be appreciated, however, that in alternative embodiments, the thermal block 112 could be configured to run the full length of the purlin. In the embodiment of FIG. 2, it can be seen that a row of intermittently spaced thermal blocks is longitudinally laid out in series to completely cover each purlin.

Next, (see FIGS. 1-2), a longitudinally extending metal bearing channel 122 is placed on top of the thermal block 112. The metal bearing channel 122 has two downwardly extending legs 123 which extend down on the sides of the block 112 to laterally contain the top of the thermal block 112. Metal bearing channel member 122, once installed, provides a supporting surface for receiving the fastening mechanisms 144 that will be used to attach the clip 110 to the purlin 102 and secure the clip 110, channel member 122, and block 112 over the purlin top. This is done using fastening mechanisms 144, which, in some embodiments, are self-drilling screws which are dropped through prepunched holes (not shown) in each clip floor. Thus, the clip, which is above the block 112 already positioned on the purlin top 118, can receive the screws 144 through the prepunched holes in the bearing channel 122. In an alternative embodiment, it is optionally possible to prepunch bores through the thermal block 112 to help guide the fasteners upon insertion. In a preferred embodiment, the top 118 of the purlin 102 is prepunched with holes positioned to receive the fasteners at the proper locations. The holes in the purlin top are of a diameter such that they will easily receive and guide the screws, but will also allow the fastener to bite into the purlin and provide the resistance necessary when the screw is torqued. Each screw has a head 146 which pushes down on the metal cap 122 when the fastener 144 is screwed in, and a tip 148 which penetrates the horizontal top 118 of purlin 102 so that the screw threads can dig into it. This secures the thermal block 112 on top of the purlin 102, sandwiching the vapor-barrier sheet 127 between the two parts.

Vapor-barrier sheet 127 is secured and clamped down over the top 118 of purlin 102 by the thermal cap 112 as shown in FIG. 2. As can be seen in FIG. 1, the engaging surfaces of the thermal cap 112 include an inside vertical wall 128, a horizontal ceiling 130, an elbow portion 132, and an outwardly angled inside surface 134. Inside vertical wall 128 and horizontal ceiling 130 are adapted to conform to the upper portion of vertical web portion 116 and the horizontal top 118. Elbow 132, however, does not conform to the downwardly sloped front lip 120 of Purlin 102. Rather it defines a gap 135. The slope of face 134 is dramatically downward, whereas the surface opposite 128 is vertical. Vapor-barrier sheet 127, as can be seen in the figure, is secured between all of the engaging surfaces of the purlin 102 and the block 112, and is located loosely in the gap area 135 (see below).

Once the thermal blocks 112 have been fastened on, the spacer blocks 114 are lined up above them between each clip 110 (see FIG. 2). One block end on each spacer block has a protruding portion 124 which extends out from an end face 126. The other end 129 of each spacer block 114 has a centrally recessed area 125 surrounded by two protrusions 129. The recessed area 125 is shaped to receive the protruding portion 124 on the end face 126 on the next spacer block 114 in the series atop the purlin. Thus, joints 131 are formed about the clips 110 where the ends of the spacer blocks 114 meet, and the spacer blocks 114 span between each of the clips 110.

Once the spacer blocks 114 have been put into place, the batt insulation 108 can be unrolled into the space created above the vapor-barrier sheet 127, and between the blocks 112 and 114 on each side, as illustrated in FIG. 2. The lateral boundaries for the insulation 108 are defined on one side by a right vertical sidewall 136 of thermal block 112, which is aligned (when viewed in cross-section) with the right vertical sidewall 138 of the spacer block 114 above it. On the opposite side of the structure, a left vertical sidewall 140 of the thermal block 112 is aligned with the left vertical sidewall 142 of the spacer block 114. These walls 136, 138, 140, and 142, along with the vapor-barrier sheet 127, create a receiving area for the batt insulation 108. The receiving area is a cavity defined by an upper surface of the vapor-barrier sheet 127 and between opposing faces of each spaced apart thermal block arrangement (e.g., face 136 and the opposing face off of the page to the right in FIG. 1 would define the opposing walls). The cavity created between the purlins is substantially rectangular in cross section. In one embodiment, the cross-sectional width and height of this cavity are configured to match the cross-sectional height and width of an a commercially available batt insulation product. In embodiments, the cavity is substantially shaped as a rectangular parallelepiped receiving area into which the batt insulation 108 can be unrolled.

After the insulation 108 has been unrolled into the receiving cavity, created (as shown in FIGS. 1-2), the upper flanges 107 of the clip 110 (which is already secured to the top 118 of the purlin 102) can be folded into a seam 106 of the roof structures 104 in a known manner to complete the roof.

Many different arrangements of the various components depicted, as well as components not shown, are possible without departing from the spirit and scope of the present invention. Embodiments of the present invention have been described with the intent to be illustrative rather than restrictive. Alternative embodiments will become apparent to those skilled in the art that do not depart from its scope. A skilled artisan may develop alternative means of implementing the aforementioned improvements without departing from the scope of the present invention.

It will be understood that certain features and subcombinations are of utility and may be employed without reference to other features and subcombinations and are contemplated within the scope of the claims. Not all steps listed in the various figures need be carried out in the specific order described.

The invention claimed is:

1. A system, comprising:

a thermal block arrangement over each of an opposing pair of purlins;

a vapor-barrier member spanning between and secured over opposing pairs of purlins, the vapor-barrier member extending between each thermal block arrangement having engaging surfaces that hold the vapor-barrier member over the head of each purlin such that the vapor-barrier member spans between each purlin at a level below each purlin head;

an insulation receiving cavity defined by an upper surface of the vapor-barrier member and between opposing faces of each of the thermal block arrangements, the cavity being substantially rectangular in cross section;

wherein the engaging surfaces of the thermal block arrangement include:

an inside vertical wall which presses the vapor-barrier member against an upper portion of a web of the purlin;

a horizontal ceiling which presses the vapor-barrier member down on a flat top of the purlin; and an outwardly angled wall extending from said horizontal ceiling and away from said inside vertical wall holding the vapor-barrier member down, over, and below a front lip of the purlin.

2. A system, comprising:

a thermal block arrangement over each of an opposing pair of purlins;

a vapor-barrier member spanning between and secured over the opposing pair of purlins, the vapor-barrier member extending between each thermal block arrangement having engaging surfaces that hold the vapor-barrier member over the head of each purlin such that the vapor-barrier member spans between each purlin at a level below each purlin head;

an insulation receiving cavity defined by an upper surface of the vapor-barrier member and between opposing faces of each of the thermal block arrangements, the cavity being substantially rectangular in cross section;

a bearing member, the bearing member being mounted on top of the thermal block arrangement and constructed of a material which receives and secures fasteners such that a roof clip is mounted above the thermal block arrangement and seamed into a metal roof structure.

3. The system of claim 2, wherein the bearing member comprises metal.

4. The system of claim 3, wherein the bearing member includes two downwardly extending legs which extend down over each side of the thermal block arrangement.

5. The system of claim 2, wherein a plurality of spacer blocks are installed between each of a plurality of roof clips above the thermal block arrangement.

6. The system of claim 5, wherein each spacer block comprises:

a first end having a protrusion extending out from an end face; and a second end having a central recessed area adapted to receive the protrusion of another spacer block in a series of spacer blocks.

7. The system of claim 5, wherein the plurality of spacer blocks form joints at each clip, each joint being formed from a protrusion from a first spacer end passing through a clip opening and then being received in a recess in a next spacer block.

8. A method of providing insulation in a metal roof, the method comprising:

draping a vapor-barrier sheet over a plurality of purlins;

forming a bottom of each of a plurality of thermal blocks such that when the thermal blocks are placed over each purlin the vapor-barrier sheet is pushed down over a top of the purlin, thus creating an insulation receiving area between the purlins;

placing the thermal blocks longitudinally above each of the purlins;

fastening a plurality of clips above and along the length of the thermal block;

spacing additional blocks between each clip fastened such that opposing lateral walls of the additional blocks define an upper part of the insulation receiving area;

laying insulation into the insulation receiving area; and seaming the clips into a metal roof structure placed above the additional blocks and insulation.

9. The method of claim 8, comprising selecting batt insulation as a type of insulation laid.

10. The method of claim 9, comprising unrolling the insulation into the insulation receiving area to install the insulation.

11. A system for insulating a metal roof, the metal roof having a plurality of purlins, the system comprising:

a vapor-barrier sheet above the purlins;

a plurality of thermal blocks located longitudinally above each purlin, the thermal blocks being configured such that they fit over the purlins and push the vapor-barrier sheet down such that insulation receiving areas are formed between the purlins;

bearing members over the thermal blocks onto which a plurality of clips are fastened with fasteners, the fasteners being installed such that they bite into the top of the purlins and compress the thermal blocks down, sandwiching the vapor-barrier sheet therebetween;

a plurality of spacer blocks installed between the clips and further contributing to create the insulation receiving area; and a piece of batt insulation laid in each of the insulation receiving areas; wherein the clips are seamed into a metal roof structure installed above the pieces of insulation and the spacer blocks.

* * * * *